United States Patent [19]

Ford

[11] Patent Number: 4,596,372

[45] Date of Patent: Jun. 24, 1986

[54] STAND FOR SUPPORTING MATTER TO BE READ

[76] Inventor: Anthony C. Ford, 1, Foss Street, Palmyra, Western Australia, Australia, 6157

[21] Appl. No.: 686,490

[22] Filed: Dec. 26, 1984

[30] Foreign Application Priority Data

Apr. 9, 1984 [AU] Australia ..... PG4486

[51] Int. Cl.[4] ..... A47B 23/00

[52] U.S. Cl. ..... 248/444.1; 248/157; 248/446; 248/448; 248/454

[58] Field of Search ..... 248/441.1, 446, 447, 248/449, 448, 451, 452, 453, 454, 176, 157, 107, 106, 125, 465.1

[56] References Cited

U.S. PATENT DOCUMENTS

| | | | |
|---|---|---|---|
| 1,602,338 | 10/1926 | Chittenden | 248/448 |
| 1,675,621 | 4/1928 | Spencer | 248/448 |
| 1,928,926 | 10/1933 | Busby | 248/446 |
| 2,280,940 | 4/1942 | Wightman | 248/107 |
| 2,459,873 | 1/1949 | Curtis | 248/454 |
| 2,499,334 | 2/1950 | Sodergren | 248/441.1 X |
| 2,971,286 | 2/1961 | Ernst | 248/465.1 X |
| 3,514,066 | 5/1970 | Singleton et al. | 248/452 |
| 3,638,894 | 2/1972 | Leutenegger | 248/125 X |
| 4,512,603 | 4/1985 | Williams | 248/451 X |

*Primary Examiner*—Ramon S. Britts
*Assistant Examiner*—Ramon O. Ramirez
*Attorney, Agent, or Firm*—Laurence R. Brown

[57] ABSTRACT

The present invention provides a stand comprising a base portion, an upright member attached to the base portion, a cantilever member having a first end attached to the upright member and a second end rotatably secured to a frame, the frame pivotally supporting a cradle arranged to have rested upon it a book or other printed matter and the attachment of the first end of the cantilever member to the upright member enabling the height of the frame to be varied.

7 Claims, 4 Drawing Figures

STAND FOR SUPPORTING MATTER TO BE READ

The present invention relates to a stand particularly envisaged for use in supporting a book or the like to be read.

In general, stands for supporting a book whilst a person reads the book are not adjustable. Usually the prior art stands allow for reading of a book whilst the person reading remains in only one given position, such as standing or sitting for example.

The stand of the present invention is adjustable to allow use by a person adopting any of a variety of postures.

In accordance with the present invention there is provided a stand comprising a base portion, an upright member attached to the base portion, a cantilever member having a first end attached to the upright member and a second end rotatably secured to a frame, the frame pivotally supporting a cradle arranged to have rested upon it a book or other printed matter and the attachment of the first end of the cantilever member to the upright member enabling the height of the frame to be varied.

The present invention will now be described, by way of example, with reference to the accompanying drawings, in which.

Figure 1:
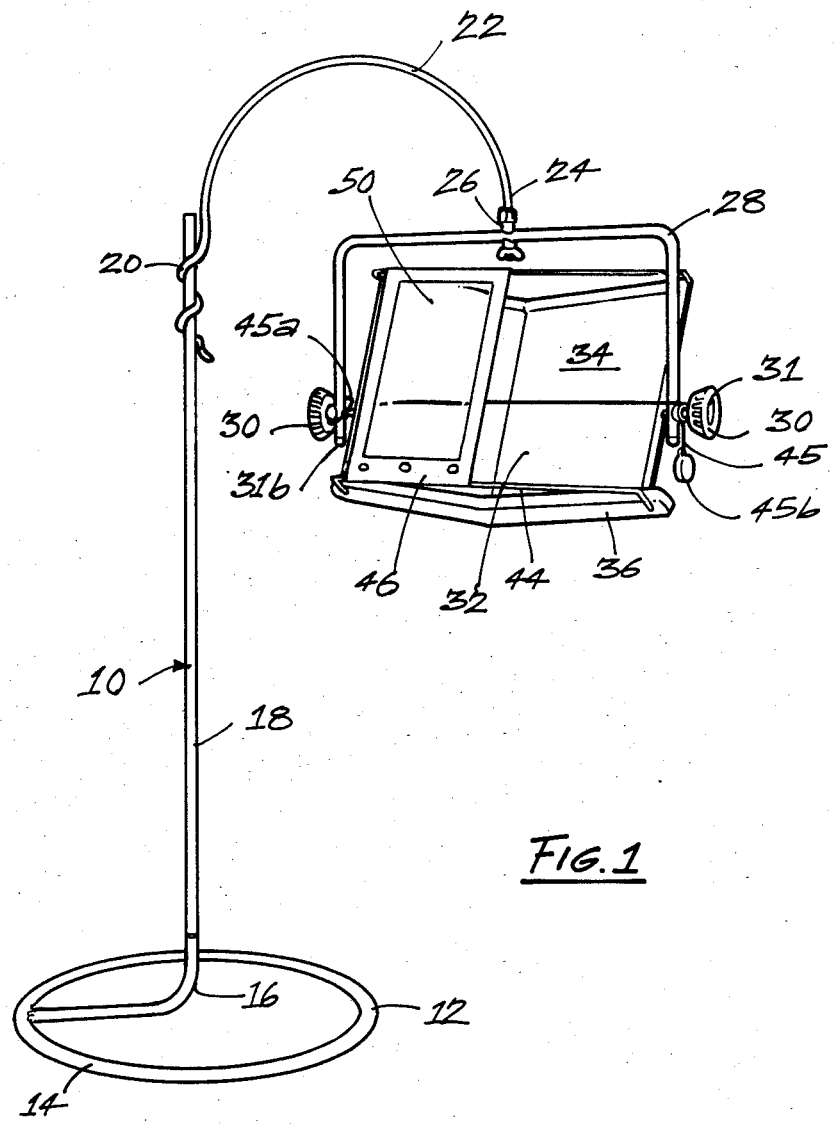
FIG. 1 is a front upper perspective view of a stand in accordance with the present invention.
Figure 2:
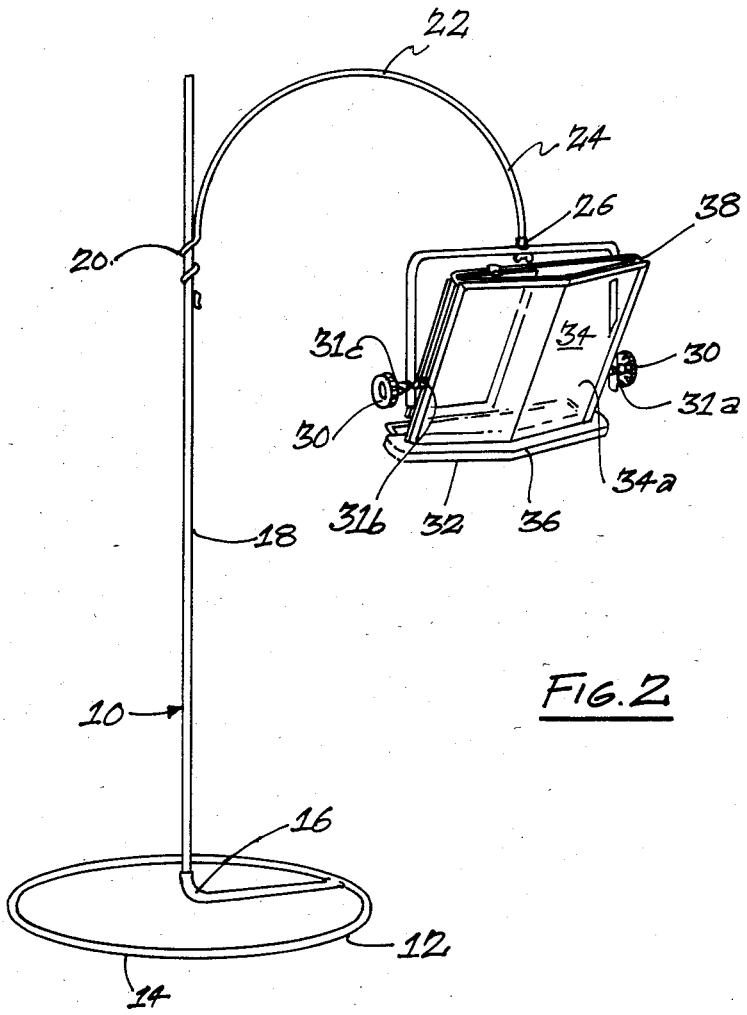
FIG. 2 is a rear upper perspective view of the stand of FIG. 1.

In FIGS. 1 and 2 there is shown a stand 10 comprising a base portion 12. The base portion 12 comprises an annulus 14 which is to be arranged, in use, adjacent a floor. The annulus 14 may be formed of solid or tubular plastics material or metal material or the like.

The base portion 12 also comprises an upwardly projecting stem 16. The stem 16 is provided with means to receive and removably locate an upright member 18. The stem 16 could be substantially hollow to fit about a lower extent of the upright member 18. Alternatively, the upright member 18 could be of larger dimension than the stem 16. The upright member 18 could then be removably located about an upper extent of the stem 16.

It is envisaged that the base portion 12 could be provided with castors or wheels to give the stand 10 of the present invention mobility. Also, it is envisaged that the castors or wheels could be retractably mounted on the base portion 12. The upright member 18 is an elongated member arranged to have slidably attached to it a first end 20 of a cantilever member 22. The first end 20 is of a shape suitable to fit about the upright member 18, such as a spiral shape as shown in FIGS. 1 and 2.

The cantilever member 22 comprises a second end 24 provided with an attachment means 26 to removably attach the cantilever member 22 to a frame 28 of an inverted U-shape. The attachment means 26 allows the frame 28 to be rotated about the second end 24 of the cantilever member 22 in a substantially horizontal manner about a substantially vertical axis. The cantilever member 22 thus provides connection between the upright member 18 and the frame 28. The first end 20 of the cantilever member 22 is arranged to be rotated about the upright member 18 with the upright member 18 constituting a substantially vertical axis. The axes of rotation of the first end 20 and the second end 24 of the cantilever member 22 are, in use, orientated substantially vertical and parallel to each other to facilitate rotation of the frame 28 to any desired position. Furthermore, the first end 20 of the cantilever member 22 may be raised and lowered on the upright member 18 to a desired height to raise and lower the frame 28 above a floor upon which the stand 10 rests.

The cantilever member 22 and attached frame 28 has its height relative to the base portion 12 maintained by a locking action of the first end 20.

There is a moment of inertia produced by the frame 28 and whatever is attached thereto. The moment of inertia acts to force a part of the first end 20 against one side of upright member 18 and a further part of the first end 20 against an opposite side of the upright member 18. Thus, the moment of inertia produced serves to locate the cantilever member 22 at a chosen height on the upright member 18.

The frame 28 is provided with a horizontally opposed pivot means 30 adjacent the outer ends of the U-shape. Each pivot means 30 comprises a wheel 31 having an internally threaded shaft **31*a* attached thereto. The shaft 31*a* is threadedly engaged with a stud 31*b*. The stud 31*b* has a first end attached to a side of the cradle 32 such as by welding. Adjacent the cradle 32 the stud 31*b* has a relatively wide portion and remote from the cradle 32 the stud 31*b* has a relatively narrow portion. The relatively narrow portion of the stud 31*b* passes through an aperture in the frame 28 and projects from the outer side thereof. There is a shoulder between the wide and narrow portion of the stud 31*b* and this shoulder abuts the inner side of the frame 28. On the outer side a shaped washer 31*c* is mounted about the narrow portion of the stud 31*b* between the shaft 31*a* and the frame 28. The washer 31*c* is shaped so as to fit snugly against the shaft 31*a* and the frame 28. At least the outer end of the narrow portion of the stud 31*b* is threaded so that it can threadedly engage the shaft 31*a*. The pivot means 30 may be locked to prevent pivoting of the cradle 32 by tightening the threaded shaft 31*a* of the wheel 31 on the stud 31*b***.

In reverse manner the pivot means 30 may be slackened by partially disengaging the wheel 31 with the stud **31*a* to allow pivoting of the cradle 32**.

The cradle 32 comprises a "V" shaped pallet 34 suitable to receive, in use, a book or other printed matter. The pallet 34 has a peaked side **34*a* and a valley side 34*b*. Preferably, the pallet 34 is formed of a transparent material such as a transparent plastics material so that a book or other printed matter may be placed on the peaked side 34*a* of the pallet 34 and may be read through the pallet 34**.

Figures 3, 4:
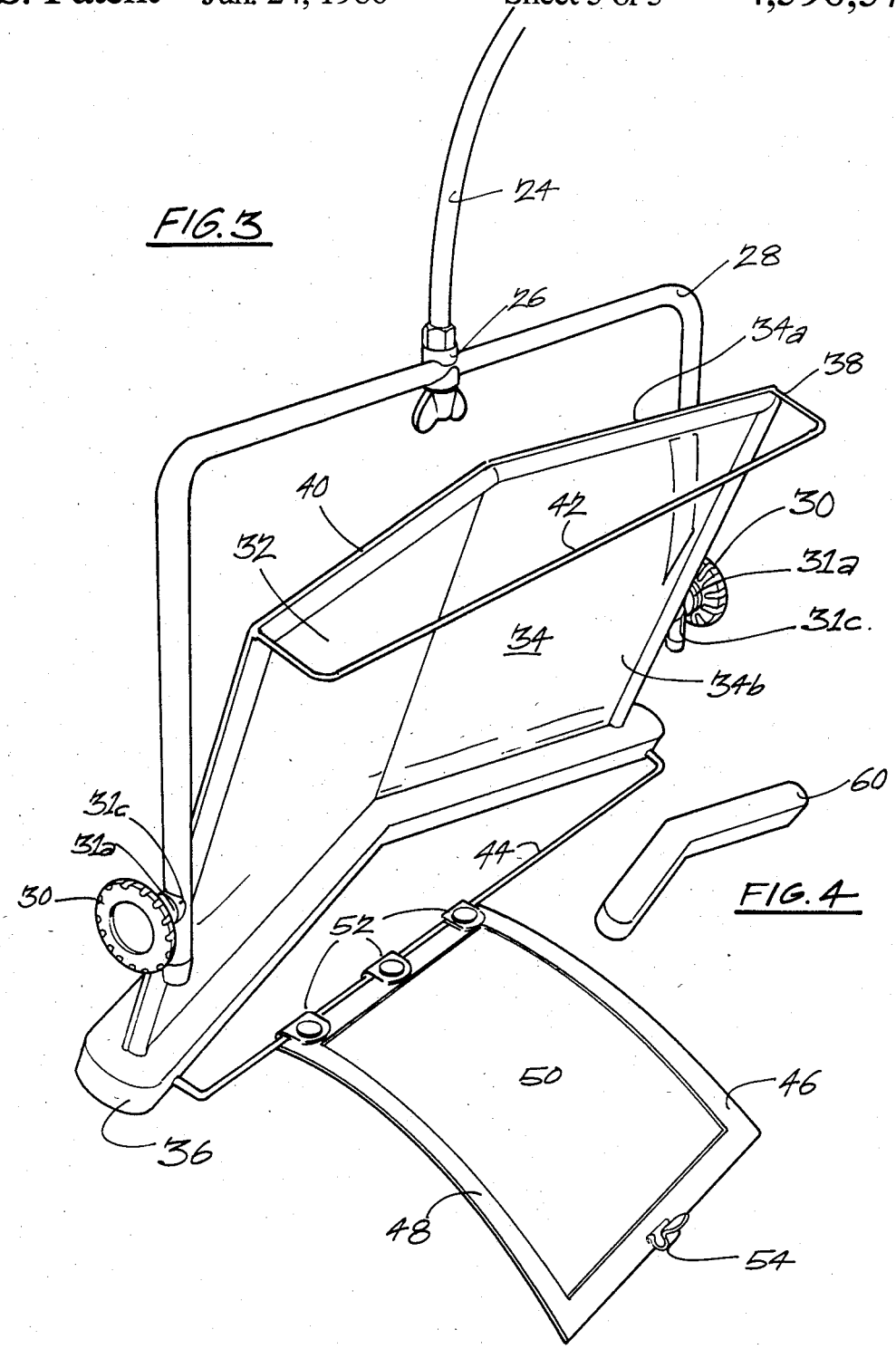
FIG. 3 is an upper perspective view of a frame and a cradle of the stand of FIG. 1.
FIG. 4 is an upper perspective view of a block to be used in relation to the stand of FIG. 1.

The cradle 32 also comprises an abutment 36 located at a lower end of the pallet 34. The abutment 36 is of a similar "V" shape as that of the pallet 34, as shown in FIG. 3.

The cradle 32 has attached about a substantial extent of its perimeter a further frame 38. The further frame 38 comprises a wire surround 40 which surrounds the top and sides of the pallet 34 and extends into apertures in the abutment 36.

The wire surround 40 is attached to the pivot means 30 on opposing sides of the pallet 34. The pivot means 30 thus allows the cradle 32 to be pivoted within the frame 28 about a substantially horizontal axis. The pivot means 30 can be slackened off to allow adjustment of the position of the cradle 32 and then tightened to retain the cradle 32 in a desired position.

The further frame 38 also comprises an upper rack 42 and a lower rack 44 attached to the wire surround 40.

The rack 42 extends from the upper end of the wire surround 40 on the valley side 34*b* and the rack 44 extends from the lower end of the wire surround 40 through grooves in the abutment 36 on the valley side 34*b*.

Further, the first end of each stud 31*b* is attached such as by welding to the wire surround 40.

As shown in the Figures, there is also provided a weighted cord 45 extending across the valley side 34*b* and clipped to one of the pivot means 30 by means of a clip 45*a*. At its end opposite the clip 45*a* the weighted cord 45 is provided with a weight 45*b*. The weighted cord 45 provides resistance to pages of a book being turned by a breeze or the like.

It is envisaged that the weighted cord 45 could comprise fishing line or the like transparent cord.

The racks 42 or 44 are intended to have removably attached to them a viewer 46. The viewer 46 comprises a border 48 having mounted therein a magnifying means 50.

The viewer 46 is removably attached to one of the racks 42 or 44 by one or more press stud secured straps 52 located at one end of the viewer 46. At an opposite end of the viewer 46 there is provided a clip 54 used to clippably secure the viewer 46 to the other of the racks 42 or 44. The viewer 46 may be removed from the racks 42 and 44 by unclipping the clip 54 and opening the press stud secured straps 52.

The straps 52 and the clip 54 allow the viewer 46 to be, in use, slid along the racks 42 and 44. Thus, the viewer 46 can be located adjacent either face of the valley side 34*b* of the pallet 34.

It is envisaged that any means could be used to secure the viewer 46 to the racks 42 and 44 provided the viewer 46 can be located adjacent either face of the valley side 34*b* of the pallet 34. For example, the viewer 34 could be removably and pivotally secured to an elongated member (not shown) located intermediate of the length of the racks 42 and 44 and disposed between them to form a substantially vertical pivot. The viewer 34 could then be flipped from one face of the valley side 34*b* about the elongated member and to the other face of the valley side 34*b*.

Furthermore, it is envisaged that any shape of racks 42 and 44 could be used provided the viewer 34 can be located adjacent both faces of the valley side 34*b* of the pallet 34. For example, the racks 42 and 44 could be of a similar "V" shape as the pallet 34 and the abutment 36.

The stand 10 of the present invention also comprises a block 60, shown in FIG. 4. The block 60 is of a complementary shape to the valley side 34*b* and peak side 34*a* of the pallet 34. The block 60 may, thus, be rested in the valley side 34*b* or on the peak side 34*a* of the pallet 34. The block 60 is provided to elevate small books and other printed matter to a level such that they may more readily correspond with the magnifying means 50 of the viewer 46. In use, the stand 10 of the present invention is intended to support a book, printed matter or the like to be read. The stand 10 may be moved to a location at which a person desires to read a book. The book may be placed on the valley side 34*b* or peak side 34*a* of the pallet 34. Then the cradle 32 comprising the pallet 34 may be pivoted in the frame 28, as described hereinabove to an angle suitable to support the book.

For example, the position of the pallet 34 in FIGS. 1 and 2 is suitable to support a book in the valley side 34*b* of the pallet 34. Such a positioning would be suitable for a person standing or sitting and looking down on the book. The book may, alternatively, be placed on the peak side 34*a* of the pallet 34, if the pallet 34 is positioned in a manner similar to that shown in FIG. 3. Then a person lying down or sitting under the book may look up and through the pallet 34 to read the book resting on the peak side.

The height of the book above the floor is adjusted by gripping the cantilever member 22, holding the weight of the frame 28 and whatever is attached to it, in order to remove the locking moment of inertia. Then the cantilever member 22 and th frame 28 and the pallet 34 may be raised and lowered to a desired height. The cantilever member 22 is then relocked by releasing the frame 28 to re-apply the moment of inertia.

Thus, the cradle height and tilt may be adjusted to suit a person wishing to read a book whilst maintaining a particular posture.

The viewer 46 may be removed from the racks 42 and 44 by unclipping the clip 54 and unfastening the press stud secured straps 52. The viewer 46 may be reattached to the racks 42 and 44 in reverse manner.

When reading a book supported in the valley side 34*b* against the abutment 36 or the block 60 a reader may read a first page on the left face of the valley side 34*b*. Then the reader may slide the viewer 46 across to the right face of the viewer to read a second page of the book. The reader may turn the pages of a book in the usual manner with the weighted cord 45 providing some restraint against pages being turned by a breeze or the like.

When reading a book supported on the peak side 34*a* against the abutment 36 or the block 60 a reader must remove the book to turn pages. The viewer 34 may then be operated as described hereinabove.

The stand 10 of the present invention may be dismantled for storage. Dismantiling is achieved by removing the frame 28 from the second end 24, lifting the cantilever member 22 of the upright member 19 and removing the upright member 22 from the base portion 12.

The stand 10 may be assembled in reverse manner.

Modifications and variations such as would be apparent to a skilled addressee are deemed within the scope of the present invention. For example, the cantilever member 22 could be attached to an upright member 18 secured to a ceiling or a wall of a building or furniture items including hospital trolleys. Also, it is envisaged that a lighting fixture could be removably attached to the cradle 32 and arranged to illuminate the pages of a book supported thereby.

I claim:

1. A stand for supporting matter to be read and comprising a base portion, an upright member attached to the base portion, a cantilever member comprising a first end attached to the upright member and a second end rotatably secured to a frame, the first end being in the form of a spiral having substantially cylindrical overall internal shape and slidably arranged about the upright member, the frame pivotally supporting about a substantially horizontal axis a cradle arranged to have rested upon it a book or other printed matter such that the weight of the frame and the cradle and the book or other printed matter arranged thereon produces a bending moment of inertia on the cantilever member, the bending movement of inertia causing the spiral of the first end of the cantilever member to lock by frictional engagement against the upright member, the spiral of the first end being unlockable by reduction of the bending moment of inertia by providing an uplift force such that the spiral of the first end can be slid along the upright member to adjust the height of the cardle.

2. According to claim 1, in which the frame is arranged to rotate about an upright axis remote from the upright member at the second end of the cantilever member.

3. A stand according to claim 1, in which the cradle comprises a pallet formed of transparent material and having first and second surfaces, the first surface and the second surface being disposed one behind the other such that the cradle can be pivoted to a position in which a book or other printed matter can be arranged, to be rested upon the first surface with the matter to be read facing upwardly, and the cradle can be pivoted to a further position in which a book or other printed matter can be rested upon the second surface, with the matter to be read facing downwardly.

4. A stand according to claim 3, in which the first surface is a valley side of the pallet and the second surface is a peaked side of the pallet.

5. A stand according to claim 3, in which the cradle is provided with a viewer means to magnify printed matter in a book received in the cradle.

6. A stand according to claim 1, in which the first end of the cantilever member has an axis of rotation about the upright member which is substantially parallel to the axes of rotation of the frame about the second end of the cantilever member when in use.

7. According to claim 6, in which the said axes of rotation are substantially vertical.

* * * * *